United States Patent [19]

Joubert et al.

[11] Patent Number: 4,844,831

[45] Date of Patent: Jul. 4, 1989

[54] USE OF METASILICATE/SILICA COMBINATION GRANULATE IN DETERGENT COMPOSITIONS FOR WASHING MACHINES

[75] Inventors: Daniel Joubert, Trevoux; Philippe Parker, Villeurbanne, both of France

[73] Assignee: Rhone-Poulenc Chimie, Courbevoie Cedex, France

[21] Appl. No.: 175,282

[22] Filed: Mar. 30, 1988

[30] Foreign Application Priority Data

Mar. 30, 1987 [FR] France ..... 87 04590

[51] Int. Cl.[4] ..... C11D 7/14

[52] U.S. Cl. ..... 252/140; 252/89.1; 252/135; 252/174.13; 252/174.25; 252/385; 23/313 R; 23/313 AS; 427/215; 427/219; 428/406

[58] Field of Search ..... 252/89.1, 135, 174.13, 252/140, 174.25, 385, 313.2; 23/313 R, 313 AS; 427/215, 219; 428/406

[56] References Cited

U.S. PATENT DOCUMENTS

| | | | |
|---|---|---|---|
| 2,895,916 | 7/1959 | Milenkevich et al. | 252/99 |
| 2,913,419 | 11/1959 | Alexander | 252/313 |
| 3,208,822 | 9/1965 | Baker et al. | 23/110 |
| 3,503,790 | 3/1970 | Gringras | 117/100 |
| 3,687,640 | 8/1972 | Sams et al. | 23/313 |
| 3,868,227 | 2/1975 | Gericke et al. | 23/313 |
| 4,397,777 | 8/1983 | Yurko | 252/140 |
| 4,452,909 | 6/1984 | Yang | 502/69 |

*Primary Examiner*—Paul Lieberman
*Assistant Examiner*—Hoa Van Le
*Attorney, Agent, or Firm*—Finnegan, Henderson, Farabow, Garrett & Dunner

[57] ABSTRACT

The use of combination granulates consisting of metasilicate and silica in detergent products. These combination granulates can particularly be used as anti-redeposition and antisoiling agents in detergent compositions for washing laundry.

11 Claims, 1 Drawing Sheet

Figure 1:
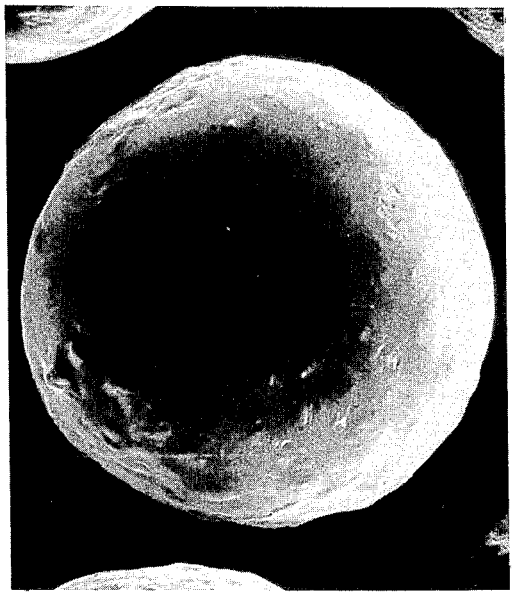

USE OF METASILICATE/SILICA COMBINATION GRANULATE IN DETERGENT COMPOSITIONS FOR WASHING MACHINES

The present invention relates to the use of combination granulates consisting of metasilicate and silica in detergent products. It relates more specifically to their use as antisoiling, anti-redeposition and anti-incrustation agents in detergent compositions for washing laundry.

Current ecological pressures are obligating detergent manufacturers to decrease the level of phosphate present in washing powders. Thus, since many countries have adopted standards for maximum levels of phosphates that can be present in detergents, all manufacturers of detergent compositions are seeking a substitute for tripolyphosphate, which substitute must have all the advantages of tripolyphosphate.

Representative advantages of tripolyphosphate include (1) a maximal efficacy which results in a removal of soil from the fibers and its maintenance in suspension, better known as the "anti-redeposition effect," and (2) an effect of complexing the calcium present in the water, better known as the "softening effect."

Tripolyphosphate is, moreover, a product that is nontoxic to either man or animals, since it is completely biodegradable. It is manufactured at minimal cost, thereby enabling the user to be offered detergents at low prices.

A major disadvantage of tripolyphosphate is that it causes the eutrophication of water by proliferation of algae.

As proposed substitutes for replacing tripolyphosphate, many products, including polymers, have been synthesized. Some of these are more detrimental to the environment and man than tripolyphosphate, while some others are costly to produce or possess inferior qualities.

The present invention can solve the above-mentioned problem. Among the inorganic products that are usable in detergent products, there is a class of products which possess properties not very different from those of phosphates, which are not detrimental to the environment and which industry can produce at a reasonable cost, making it possible to avoid an irreversible increase in the cost of a barrel of washing powder.

The compounds which are the subject of the present invention are silicates having a well-defined composition.

Certain silicates, and in particular metasilicates, are commonly used in detergent compositions. They provide properties of corrosion inhibition with respect to metals, but they exhibit the unfortunate property of incrustation of the laundry when water of great hardness is used.

When the silicate is introduced into the composition by dry mixing, the silicate must be faultless in its presentation, since appearance in the detergent field often has considerable commercial consequences. The silicate particles must exhibit good whiteness, a spherical shape and a uniform particle size distribution to avoid sedimentation within the barrel of powder.

The starting materials must, in addition to their characteristics of appearance, exhibit good storage stability. Detergent compositions are sometimes stored for relatively long periods, under humidity and temperature conditions which are often highly variable. The detergent composition must, after these storage periods, maintain the form of a fluid powder, preferably free from aggregates due to caking. In addition to this physical stability, the detergent powder must show chemical stability. Thus, in the course of the variations in humidity, the silicate must not degrade the more labile constituents such as perfumes, chlorinated salts and nonionic surfactants such as polyoxyethylene glycols.

The particular silicate used in detergent compositions in accord with the present invention differs from silicates used in the past and is a combination granulate of metasilicate and silica. It possesses an average mole ratio of $SiO_2/Na_2O$ ranging from 1.2 to 2.6. The combination granulate is prepared, for example, by compaction under pressure of a mixture of metasilicate and silica introduced in the form of a fine powder to obtain a homogeneous granulate. The combination granulate preferably contains the metasilicate and silica described in French Patent Application No. 86/07,764, which discloses the use of such combination granulates in dishwashers.

The combination granulate possesses an average mole ratio of $SiO_2/Na_2O$ ranging from 1.2 to 2.6, and preferably comprises a core of metasilicate and a peripheral region consisting at least partially of silica. The ratio of the diameter of the metasilicate core to the diameter of the overall combination granulate is preferably greater than 0.80.

The combination granulate of the invention preferably possesses an average mole ratio of $SiO_2/Na_2O$ ranging from 1.2 to 2.2. It possesses a preferable specific gravity ranging from 0.85 to 1.2, which is greater than that of the silicate granules of the prior art which, in addition to having a lower specific gravity, also have an $SiO_2/Na_2O$ ratio equal to 2.

The water content, calculated by weight with respect to the weight of the combination granulate, preferably ranges from 15% to 40%.

For improved use in detergent compositions, it is preferable to have a combination granulate particle average diameter ranging from 0.3 mm to 1.8 mm. The average diameter of the combination granulate according to the invention is preferably from 0.5 mm to 0.8 mm. This value is not essential; it is simply preferred because the other constituents of the detergent composition already have this particle size.

The preferred combination granulate of the present invention have the following properties:

greatly reduced surface alkalinity, high specific gravity, on average approximately 1, very good stability, both in a hot atmosphere and in a humid atmosphere, very good compatibility with chlorinated salts, surfactants, perfumes and natural products that are sensitive to very alkaline pH (enzymes), and good resistance to abrasion.

These products can be preferably obtained using the following method of preparation and starting materials.

Representative starting materials include granules of metasilicate pentahydrate, optionally mixed with anhydrous metasilicate. The ratio of anhydrous metasilicate to metasilicate pentahydrate in the combination granulate is preferably less than 1. If this ratio is too high it becomes difficult to form the peripheral region of silica around the core of metasilicate.

The metasilicate pentahydrate may be very diverse in its origin. It is preferable, however, to use a granular metasilicate pentahydrate having a particle size ranging from 0.2 mm to 1.6 mm.

Specifically, the metasilicate pentahydrate sold by Rhone-Poulenc under the brand name Simet® 5G is preferred.

The anhydrous metasilicate optionally used is a pulverulent compound whose particle size is preferably less than 0.6 mm. Specifically, the anhydrous metasilicate sold by Rhone-Poulenc under the brand name Simet® AP is preferred.

The silica preferably used is a pulverulent precipitated silica whose particle size is less than 0.075 mm. Specifically, the precipitated silica sold by Rhone-Poulenc under the brand name Tix-o-sil® 38 A is highly preferred.

In the process for preparing the combination granulate possessing a mole ratio of $SiO_2/Na_2O$ ranging from 1.2 to 2.6, which is the subject of the French Patent Application No. 86/07,764, a thermal granulation is performed during a first stage by bringing granules of metasilicate pentahydrate into contact with silica at a temperature ranging from 60° to 75° C., and, during a second stage, the mixture is cooled and an aging is performed leaving a quantity of water ranging from 15% to 40% by weight, in the combination granulate. This causes, at the surface or peripheral region, adhesion of the silica and its partial conversion to silicate having a mole ratio of $SiO_2/Na_2O$ greater than 2.

The first stage of the process utilized to make the combination granulate of the present invention is preferably performed by bringing into contact granules of silica and granules of metasilicate pentahydrate optionally mixed with anhydrous metasilicate in a conventional powder mixing apparatus such as a rotating drum, granulating plate, fluidized bed or powder mixers of the Lodige, Vidax or Spangenberg type. It is preferable, however, to use a rotating drum.

The quantities of powder, selected by one skilled in the art according to the mole ratio desired in the combination granulate to be obtained, are introduced into the mixer. The powder mixer is then heated by any means, but preferably by radiant heating, in particular by infrared or microwave. The radiant heating is preferably employed to be perpendicular to the wall of the mixer.

A relative humidity corresponding to that of the vapor pressure of the metasilicate pentahydrate at its melting point, i.e., a relative humidity, expressed as water pressure, of greater than $2\times10^4$ pascals, is preferably maintained inside the reactor.

The heating is preferably maintained for 20 to 60 seconds from the instant when the powder mass has reached the desired temperature of 60°-75° C.

The second stage of the process according to the invention consists of cooling the mixture obtained from the first stage and providing for an aging of the mixture.

The same equipment that can be used for the granulation can be used as the aging apparatus. It is preferable to use a fluidized bed.

This aging of the mixture is preferably performed for a period of 5 to 15 minutes when a fluidized bed is used as the aging apparatus, and 5 to 30 minutes when a rotating drum is used as the aging apparatus.

If the aging is performed at a higher temperature and for a longer period of time (for example in the region of one hour), the water of the metasilicate pentahydrate tends to migrate and to convert the surface layer of silica to silicate having a high $SiO_2/Na_2O$ ratio.

The products obtained by the present process all possess lower surface alkalinity compared with metasilicates, and even compared with silicates possessing the same overall ratio but obtained by another process. This lower surface alkalinity results in reduced safety problems which often arise as a result of ingestation of detergents by children.

The combination granulates of the present invention can be used as anti-redeposition, anti-incrustation and antisoiling agents in a wide variety of detergent compositions that either do or do not contain tripolyphosphate. If tripolyphosphate is present, the combination granulates of the present invention can replace part of the tripolyphosphate as a builder in washing powders.

In addition to possessing these anti-redeposition or antisoiling properties, the combination granulates of the present invention display particularly exceptional performance as anti-incrustation agents when they are used with a builder of the zeolite type. Zeolite type builders are well-known to those skilled in the art and are readily available commercially. Zeolites are described generally in D. W. Breck, *Zeolite Molecular Sieves: Structures, Chemistry, and Use,* John Wiley & Sons, Inc., New York, 1974; and J. A. Rabo, ed., *Zeolite Chemistry and Catalysis,* ACS Monograph 171, American Chemical Society, Washington, D.C., 1976.

The combination granulates of the present invention can be used as an additive to the customary builders in washing powders according to a weight ratio of combination granulates/total detergent composition of between 2% and 10%. They can also be used as replacements for the customary builders when used in much larger proportions.

FIG. 1 is a photo of the combination granulate of the present invention.

The physicochemical properties of the combination granulate of the present invention were determined by the following tests:

(1) Apparent density. This was determined by a procedure similar to that according to the standard NF T-73-405 which enables the apparent density of washing powders to be determined.

The volume of a given mass of the product to be tested was determined in a graduated cylinder, after allowing the product to drop freely and without compressing.

Two determinations were carried out per product.

(2) Water content. Water content was determined by weighing the product which had been calcinated at 550° C.

(3) Rate of dissolution. Dissolution rate was determined by following the conductivity of the solution during the dissolution of 17.5 g of the product in 500 ml of water.

The dissolution time was given by the abscissa at the starting point of the conductivity plateau. The time was expressed in seconds.

(4) Dust formation. The combination granulates of the invention are spherical beads (see FIG. 1) with a very smooth surface appearance and the granules do not form dust.

(5) Surface alkalinity. A depth of approximately 0.5 mm of a colored indicator solution such as phenolphthalein (0.05 g of phenolphthalein+50 ml of ethanol+50 ml of water) was introduced into a crystallizer.

The grains of the product obtained were allowed to drop. In the case of a prior art silicate with a $SiO_2/Na_2O$ ratio of 2, an instantaneous color change of the granule to red was observed.

The surface alkalinity therefore had a Ph greater than 10.

In the case of the combination granule described in the invention, with $SiO_2/Na_2O$ ratio=2, no instantaneous color change to red was observed. The surface alkalinity therefore had a pH less than 10. The surface alkalinity of the combination granulate described was therefore lower than that of the granules of the prior art.

(6) Behavior in solution. The dissolution of these granules causes the metasilicate to be attacked by the silica and a solution of silicate with a $SiO_2/Na_2O$ ratio equal to the overall ratio of the combination granulate was finally obtained.

This attack may be monitored by:

pH determinations, conductimetry, and turbidimetry.

Examples 1–8 describe methods for producing the combination granulate of the present invention. Examples 9 and 10 illustrate the anti-redeposition and anti-incrustation properties of the combination granulate of the present invention when used as a detergent in washing machines.

EXAMPLE 1

The following raw materials were introduced into a mixing apparatus consisting of a rotary drum:

1270 g of metasilicate Simet® 5G;

144 g of silica Tix-O-Sil® 38 A

The masses were calculated so as to obtain a combination granulate with a $SiO_2/Na_2O$ mass ratio of 2.0.

The mixer was put into rotary motion and heated by applying warm air to the outer wall.

The air within the mixer was maintained at a relative humidity, expressed as water pressure, greater than $2\times10^4$ Pascal.

When the temperature of the products reached 68° C., the very quick bonding of the silica to the metasilicate pentahydrate was observed.

The heating was discontinued and the combination granulate obtained was allowed to mature for 30 min. in the rotating mixer at ambient temperature.

Product no. 1 was obtained.

EXAMPLE 2

Example 1 was repeated introducing:

1270 g of metasilicate Simet® 5G;

206 g of silica Tix-O-Sil® 38 A

A combination granulate with an $SiO_2/NA_2O$ gravimetric ratio of 1.5 was obtained.

The mixer was heated with a row of infrared lamps installed within the drum.

When the temperature of the products reached 75° C., the bonding of the silica on the metasilicate pentahydrate was observed.

The procedure was then continued as in Example 1.

EXAMPLE 3

Example 1 was repeated, introducing the following into a granulating plate:

1270 g of metasilicate Simet® 5G 127 g of silica Tix-O-Sil® 38 A

A combination granulate with a gravimetric ratio $SiO_2/Na_2O$ of 1.31 was obtained.

The granulating plate was heated with a row of infrared lamps.

When the temperature of the products reached 71° C., the bonding of the silica to the metasilicate pentahydrate was observed.

The maturing of the combination granulate lasted for 15 minutes at ambient temperature.

EXAMPLE 4

Example 1 was repeated introducing:

1000 g of metasilicate Simet® 5 G 215 g of metasilicate Simet® AP 444 g of silica Tix-O-Sil® 38 A A combination granulate with a gravimetric ratio $SiO_2/Na_2O$ of 2.0 was obtained.

When the temperature reached 82° C., the bonding of the silica to the metasilicate was observed.

The maturing was carried out as in Example 1.

EXAMPLE 5

Example 1 was repeated introducing:

1400 g of metasilicate Simet® 5 G 90.4 g of silica Tix-O-Sil® 38 A

A combination granulate with a gravimetric ratio $SiO_2/Na_2O$ of 1.2 was obtained.

When the temperature of the products reached 75° C., the quick bonding of the silica to the metasilicate was observed.

The maturing was carried out as in Example 1.

EXAMPLE 6

Example 1 was repeated introducing:

1270 g of metasilicate Simet® 5 G 537 g of silica Tix-O-Sil® 38 A

A combination granulate with a gravimetric ratio $SiO_2/Na_2O$ of 2.3 was obtained.

When the temperature of the products reached 70° C., the bonding of the silica to the metasilicate was observed.

The maturing of the combination granulate was carried out as in Example 1.

EXAMPLE 7

Example 1 was repeated introducing:

1270 g of metasilicate Simet® 5 G 444 g of silica Tix-O-Sil® 38 A

A combination granulate with a gravimetric ratio $SiO_2/Na_2O$ of 2.0 was obtained.

When the temperature of the products reached 72° C., the bonding of the silica was observed.

The maturing of the combination granulate was carried out for four hours at 52° C.

EXAMPLE 8

Example 1 was repeated introducing the following into a granulating plate:

1270 g of metasilicate Simet® 5 G 444 g of silica Tix-O-Sil® 38 A

A combination granulate with a gravimetric ratio $SiO_2/Na_2O$ of 2.0 was obtained.

The granulating plate was heated with a row of infrared lamps.

When the temperature of the products reached 74° C., the bonding of the silica to the metasilicate was observed.

The maturing was carried out for two hours at 50° C.

TABLE I

| | EXAMPLE | | | | | | | |
|---|---|---|---|---|---|---|---|---|
| | 1 | 2 | 3 | 4 | 5 | 6 | 7 | 8 |
| $R_g$ of the granulate | 2.0 | 1.5 | 1.31 | 2.0 | 1.2 | 2.3 | 2.0 | 2.0 |
| Granulator | Drum | D | Plate | D | D | D | D | P |
| Granulation temperature °C. | 68.5 | 75 | 71 | 82 | 75 | 70 | 72 | 74 |
| Maturing/drying | M | M | M | M | M | M | D | D |
| Loss at 550° C. (%) | 32.1 | 36.9 | 37.9 | 36.2 | 39.3 | 34.7 | 27.2 | 24.2 |
| Dissolution rate(s) | 90 | 85 | 85 | 100 | 60 | 120 | 150 | 168 |
| Density | 1.02 | 1.04 | 0.99 | 1.02 | 1.02 | 1.00 | 1.00 | 0.97 |

$R_g$ = gravimetric ratio $SiO_2/Na_2O$

The advantages of the combination granulates of the present invention will be better understood with the aid of Examples 9 and 10 which follow, which must in no case be considered to limit the invention.

The tests are carried out with a silicate/silica combination granulate having an overall $SiO_2/Na_2O$ ratio equal to 2, obtained by granulation in a drum at 72° C. followed by drying. After drying, they have a water content of 23% and a specific gravity of 1.00.

METHOD UTILIZED IN EXAMPLES 9 AND 10

The method of assessing the washing performance of a detergent in Examples 9 and 10 was as follows:

Laundry was washed under conditions resembling as closely as possible those employed in actual practice, using a BRANDT brand domestic machine.

A 5-kg load of laundry, consisting of a mixture of cloths and Turkish towels, was used as a support for control test specimens which were sewn onto the cloths.

These test specimens were:

either fabrics soiled in a standard manner and provided by specialist laboratories, or unsoiled new control fabrics.

The reflectance of these specimens was measured using a GARDNER reflectometer before and after washing, and the difference that was observed is proportional to the detergent effect of the washing powder tested. The apparatus determined the reflectance of the fabric sample according to the 3 tristimulus values X, Y and Z.

In our specific case, we shall take into account only the variations in the value Y (ΔY in our tables).

This method makes it possible to distinguish:

the "primary" detergent effects, which relate to the removal of the soils or spots, and which were observed after a single wash;

the "secondary" detergent effects, which were observed after several cumulative washes and which are defined by the "redeposition" of the soils on initially clean fabrics and by the "incrustation" of the precipitates which can be produced during the wash, on these same fabrics. These secondary effects were measured by 5 cumulative washes, by means of the changes in Y for the redeposition, and by means of incineration of the fabrics at 900° C. for the incrustation.

The apparatus and reagents utilized in Examples 9 and 10 were as follows:

Common laboratory equipment,

Drum type washing machine: Brandt 844 electronic,

Undressed white cotton cloths, white Turkish towels, 5 test specimens (10 cm×10 cm) of each of the following fabrics:

* cotton, undressed white (1)
* cotton, soiled (KREFELD), grey (2)
* cotton, soiled (THE) (3)
* cotton, wine soiled (St GALL) (4)
* cotton, cocoa soiled (St GALL) (5)
* cotton, blood soiled (St GALL) (6)
* cotton, EMPA, soiled (St GALL) (7)
* polyester/cotton, EMPA soiled (St GALL) (8)
* polyester, soiled, TEST-FABRIC (USA) (9)
* cotton, TNO soiled (N.L.) (10)
* polyester/cotton, undressed white (11)
* polyester, white (12)

- town water, 33°rd of hardness (33° French scale: 330 mg $CaCO_3$/1)
- washing powder concentration: 8 g/liter.

The test procedure utilized in Examples 9 and 10 was as follows.

All the test specimens were measured, by means of the GARDNER apparatus, before washing, according to the values X, Y and Z. They were then sewn onto the cloths.

The washing was performed at 60° C., introducing 150 g of the test washing powder into the receptacle of the machine.

After the laundry had been dried, all the soiled test specimens were unstitched and their X, Y and Z values were measured again.

The differences obtained with respect to the initial values indicates the detergent performance of the washing powder on the different soils (primary effects).

The unsoiled test specimens were not unstitched. The washed soiled test specimens were replaced by other soiled test specimens, which thus constituted a fresh source of soil for the next wash, which was carried out again under the same conditions.

The operation was repeated five times and, following these five washes, after drying, the initial clean test specimens were unstitched.

The X, Y and Z values of these test specimens were then measured, and the ΔY values obtained gave the cumulative "redeposition" or "graying" after five washes.

Incineration at 900° C. gave the ash content of the fabrics, or the mineral "incrustation" of the fabrics, expressed as % by weight based on the mass of the fried test specimen of fabric before incineration.

EXAMPLE 9

The starting materials illustrated in Table 2 were introduced into a mixing apparatus consisting of a rotating drum.

TABLE 2

| FORMULATIONS | REFERENCE COMPOSITION | COMPOSITION ACCORDING TO THE INVENTION |
|---|---|---|
| Pulverized Silicate 2 $SiO_2/Na_2O$, n $H_2O$ (n equal to approximately 3) | 8.6 | |
| Silica/Meta.5$H_2O$ combination aggregates according to the invention | — | 8.6 |
| Sodium silicoaluminate (zeolite) | — | — |

TABLE 2-continued

| FORMULATIONS | REFERENCE COMPOSITION | COMPOSITION ACCORDING TO THE INVENTION |
|---|---|---|
| Anhydrous sodium tripolyphosphate | 27.5 | 27.5 |
| Sodium pyrophosphate | 2.0 | 2.0 |
| Sodium orthophosphate | 0.5 | 0.5 |
| Sodium sulfate | 17.5 | 17.5 |
| Sodium alkylbenzenesulfonate | 7.5 | 7.5 |
| Sodium stearate | 3.0 | 3.0 |
| Ethoxylated alcohol/C18-12 EO | 2.5 | 2.5 |
| Ethyoxylated alcohol C12-6 EO | 2.5 | 2.5 |
| Carboxymethylcellulose | 1.5 | 1.5 |
| Optical bleaches (Tinopal) | 0.4 | 0.4 |
| Enzymes (Esperase) | 0.3 | 0.3 |
| Sodium perborate | 25.0 | 25.0 |
| Magnesium silicate | 1.0 | 1.0 |
| EDTA | 0.2 | 0.2 |
| Redeposition after 5 washes (in domestic machine) | | |
| ΔY on cotton | −4.25 | −1.6 |
| ΔY on polyester/cotton | −0.56 | +2.1 |
| ΔY on polyester | −0.76 | +2.65 |
| Incrustation after 5 washes | | |
| % ash on cotton | 0.663 | 0.476 |
| % ash on polyester/cotton | 0.139 | 0.155 |

Example 9 corresponds to the assessment of the combination granulate according to the invention in a traditional detergent formulation, containing a substantial quantity of sodium tripolyphosphate and a traditional anti-redeposition agent for cotton, carboxymethylcellulose (CMC).

In Table 2, we have shown only the comparison of the performances in respect of the so-called "secondary" effects (5 cumulative washes).

An improvement in the anti-redeposition performance is observed very distinctly on the 3 types of textiles used.

An improvement in the anti-incrustation effect, especially noticeable on cotton, is also noted. On polyester/-cotton, there was no significant incrustation, either for the reference composition or for the composition containing the combination granulate according to the invention (the difference in the results is not significant).

The levels of incrustation are, moreover, relatively low, which is explained by the high sodium tripolyphosphate content used in this Example 9.

EXAMPLE 10

Two washing powders were prepared in the same manner as for Example 9, but the compositions were different (see Table 3). The builder system was a mixed zeolite/tripolyphosphate system and no anti-redeposition agent of the CMC type was added.

Curiously, an advantageous anti-redeposition effect was observed on cotton and on polyester which was not seen on the mixed polyester/cotton tissue.

Also, a substantial anti-incrustation effect was observed on cotton and polyester/cotton, all the more significant for being obtained with a composition having a low TPP content, under conditions that were very unfavorable since they lent themselves to a heavy mineral deposition on fabrics. The effect was noticeable both on cotton and on the mixed polyester/cotton fabric.

It is believed that the combination granulates useful in the present invention also possess anti-soiling properties.

TABLE 3

| FORMULATIONS | REFERENCE COMPOSITION | COMPOSITION ACCORDING TO THE INVENTION |
|---|---|---|
| Pulverized Silicate 2 $SiO_2$/$Na_2O$, n $H_2O$ (n equal to approximately 3) | 8.6 | — |
| Silica/Meta.5$H_2O$ combination aggregates according to the invention | — | 8.6 |
| Sodium silicoaluminate (zeolite) | 14.0 | 14.0 |
| Anhydrous sodium tripolyphosphate | 13.5 | 13.5 |
| Sodium pyrophosphate | 2.0 | 2.0 |
| Sodium orthophosphate | 0.5 | 0.5 |
| Sodium sulfate | 19.0 | 19.0 |
| Sodium alkylbenzenesulfonate | 7.5 | 7.5 |
| Sodium stearate | 3.0 | 3.0 |
| Ethyoxylated alcohol C18-12 EO | 2.5 | 2.5 |
| Ethoxylated alcohol C12-6 EO | 2.5 | 2.5 |
| Carboxymethylcellulose | — | — |
| Optical bleaches (Tinopal) | 0.4 | 0.4 |
| Enzymes (Esperase) | 0.3 | 0.3 |
| Sodium perborate | 25.0 | 25.0 |
| Magnesium silicate | 1.0 | 1.0 |
| EDTA | 0.2 | 0.2 |
| Redeposition after 5 washes (in domestic machine) | | |
| ΔY on cotton | −4.03 | −2.56 |
| ΔY on polyester/cotton | −0.21 | −0.65 |
| ΔY on polyester | −0.21 | −0.11 |
| Incrustation after 5 washes | | |
| % ash on cotton | 2.27 | 1.28 |
| % ash on polyester/cotton | 1.28 | 0.51 |

We claim:

1. A detergent composition for washing machines comprising combination granulates composed of a mixture of metasilicate and silica, said combination granulates having a mole ratio of $SiO_2/Na_2O$ ranging from 1.2 to 2.6 and a particle size ranging from 0.3 mm to 1.8 mm.

2. The composition of claim 1, wherein the mole ratio of $SiO_2/Na_2O$ ranges from 1.2 to 2.2.

3. The composition of claim 1, wherein said granulates have a water content ranging from 15% to 40%, by weight.

4. A detergent composition containing as a component the combination granulates of claim 1, said granulates being present in an amount by weight, expressed as dry matter relative to the total detergent composition, ranging from 2% to 10%.

5. The composition of claim 1, wherein the particle size of said combination granulates ranges from 0.5 mm to 0.8 mm.

6. The composition of claim 1, wherein said metasilicate comprises a mixture of metasilicate pentahydrate and anhydrous metasilicate.

7. The composition of claim 6, wherein the specific gravity of said combination granulates ranges from 0.85 to 1.2.

8. The composition of claim 1, further comprising a builder of the zeolite type.

9. The composition of claim 8, wherein said builder of the zeolite type is sodium silicoaluminate.

10. A method of washing laundry comprising the step of contacting in a washing machine, soiled laundry, water and a composition comprising combination granulates composed of a mixture of metasilicate and silica having a mole ratio of $SiO_2/Na_2O$ ranging from 1.2 to 2.6 for a time sufficient to clean said laundry.

11. The method of claim 10, wherein said combination granulates comprise a core of metasilicate and a peripheral region consisting at least partially of silica.

* * * * *